US005320197A

United States Patent [19]

Connerley et al.

[11] Patent Number: 5,320,197

[45] Date of Patent: Jun. 14, 1994

[54] SEXTUPLE UPRIGHT

[75] Inventors: James J. Connerley, Georgetown; Jack O. Rocco, Versailles; Ronald L. Weber, Lexington, all of Ky.

[73] Assignee: Clark Material Handling Company, Lexington, Ky.

[21] Appl. No.: 19,972

[22] Filed: Feb. 19, 1993

[51] Int. Cl.[5] ..... B66B 9/20

[52] U.S. Cl. ..... 187/9 E; 187/95; 414/910; 414/911

[58] Field of Search ..... 187/9 E, 1 R, 95; 414/910, 911

[56] References Cited

U.S. PATENT DOCUMENTS

| | | | |
|---|---|---|---|
| 3,414,086 | 12/1968 | Ulinski | 187/9 E |
| 3,705,658 | 12/1972 | Harris | 414/910 X |
| 3,841,442 | 10/1974 | Erickson et al. | 187/9 E X |
| 3,851,732 | 12/1974 | Wagner et al. | 187/9 E X |
| 4,261,438 | 4/1981 | Olson | 187/9 E |
| 4,279,567 | 7/1981 | Thompson | 414/910 X |
| 4,430,040 | 2/1984 | Halmos | 414/911 X |
| 4,432,438 | 2/1984 | Robinson, Jr. | 187/9 E |
| 4,721,187 | 1/1988 | Riddle | 187/9 E |
| 4,765,441 | 8/1988 | David et al. | 187/9 E |
| 4,896,748 | 3/1990 | Mikkelsen et al. | 187/9 E |

OTHER PUBLICATIONS

Clark Corp., Industrial Truck Division "Clark 500 Series," Apr. 25, 1984.

*Primary Examiner*—Robert P. Olszewski
*Assistant Examiner*—Dean A. Reichard

[57] ABSTRACT

An upright, particularly for a counterbalanced, high lift truck, comprising first and second telescoping dual mast sections disposed in fore and aft relationship, each section having laterally spaced outer, intermediate, and inner rails, and a load carriage elevatable on the inner rails of the front mast section providing a five-stage, sextuple upright. The carriage has side thrust and vertical guide roller pairs travelling in anti-friction engagement on the inner rails spaced to distribute the forces for reducing roller wear and rail distortion. The carriage has a free lift that leaves the top of the carriage flush with the top of the upright reducing the possibility of ceiling damage. The carriage also does not extend laterally beyond the sides of the mast section to reduce interfering with objects alongside the lift, such as storage racks, when engaging a load. The rails and carriage overlap to a high degree thereby allowing loads to be lifted by a truck having a smaller capacity.

12 Claims, 7 Drawing Sheets

SEXTUPLE UPRIGHT

FIELD OF THE INVENTION

This invention pertains to the field of load lifting apparatus used in material handling applications and particularly to a high lift upright for counter balanced, rider industrial lift trucks.

BACKGROUND OF THE INVENTION

Highly extendable lift truck upright assemblies present difficult problems with respect to resolving a variety of factors which affect the productivity, product integrity, lift truck capacity and safety, to name a few. Essentially, these demands on the structure are not always resolved to the optimum level in a general application, high lift truck upright, and even less so for one of special application.

A special application for which this present invention is primarily suited is in connection with material handling in the carpet industry. Typically, twelve foot long rolls of carpet will be stored in high racks above the warehouse floor. To reach such heights it is necessary for the lift truck to have a multi-stage, or high lift upright, capable of reaching, at maximum extension, the upper racks for inserting a ram the length of the spool down the center of the carpet roll.

One of the difficulties of multi-stage uprights is the visibility. The operator must look between the rails to see and maneuver the truck. In the high lift condition, he must look through the overhead guard in addition. It is very difficult to accurately position the tip of the ram to line it up with the carpet spool under such conditions.

Also, conventional multi-stage uprights for high lift applications tend to have a vertical height in the collapsed position that is too tall for many doorways and truck trailers.

High lift applications also require larger counterweight. That is to say, a larger lift truck is normally required to mount such uprights because the load center forward of the front axle of the truck, which acts as a fulcrum, is greater.

The special application carpet handler truck requires that the standard fork bar carriage have a carpet ram attachment mounted on the carriage after removing the forks. Since the attachment is not an integral part of the upright and carriage, it increases the distance in front of the axle to the load center, further reducing the capacity of the truck.

Also standard multi-stage uprights tend to have a free lift, which does not take into account the problems in handling carpets. For example, the carriage extends out beyond the sides of the upright; however, with a carpet ram attachment, this additional width can cause obstructions and impair maneuverability of the truck.

Also, at maximum free lift, the top guide rollers of the carriage may extend above the upright tending to cause damage to the ceiling of trailers or other structures. When maneuvering carpet rolls there is a tendency to misjudge where the end of the roll is relative to the rack, or where the end of the ram is relative to the carpet roll when aligning the ram with the spool elevated twenty-seven feet, or more above the floor.

Also, it is not uncommon to have the carpet ram attachment off center to the load carriage causing an unstable condition which is not easily detected until the load is lifted.

SUMMARY OF THE INVENTION

In overcoming these and other difficulties and particularly for a special high lift upright for use in carpet warehouse applications, the present invention provides first and second telescoping, dual mast sections disposed in fore and aft relationship, each having outer, intermediate and inner laterally spaced rails, hydraulic cylinders connected to a source of hydraulic power, such as a pump driven by the lift truck, and a lifting system powered by the cylinders. A carriage travels vertically on the inner rails of the front mast section. It is elevatable to a maximum free lift height below the top of the front mast section. Then in sequential fashion, the moveable rails are staged rearwardly from the carriage toward the truck until the upright is extended to its maximum lift height. The mast sections are structurally joined at the interface by heavy bracket plates providing a recess toward the rear mast section such that the front mast section is overlapped and offset relative to the rear mast section but the rails are laterally spaced outwardly from the centerline to provide a wide angle of vision forward of the upright.

In the design for special carpet handling applications, the carriage has laterally spaced roller pairs that travel in the inner rails and adjustable side thrust rollers engage longitudinal edges of the rails to stabilize the carriage and center the carpet ram.

The carriage rollers traveling inside the rails are retained or trapped below the top and are vertically spaced to distribute the load producing less rail distortion and better load control.

The upright is a five (5) stage, sextuple, 2 × 3, front-to-back-joined, dual-triple mast, longitudinally overlapped and laterally offset staged front to rear, providing the most compact of structures whereby a smaller capacity truck can lift heavier loads to greater heights.

The present invention accomplishes such objectives, in part, by having extendable rails overlapped in a double offset array reducing the distance from the front axle of the truck to the load center of extraordinarily long loads, such as a carpet roll.

In addition, the load carriage rollers offset and overlapped at the front recessing it toward the inner rails and thrust rollers are adjustable to maintain the carriage back plate absolutely centered.

The carriage extends laterally within the width of the upright to avoid reducing the maneuverability of the truck unlike a standard carriage which has a top fork bar from which the forks are hung allowing them to be shifted sideways, beyond the sides of the upright; however, with the present invention, the load carriage is designed to handle carpet rolls. It has an elongated ram rigidly mounted to the back plate of the carriage. The carriage is integrally offset and recessed toward the front mast section to further reduce the load center.

Another advantage of the invention is the high visibility from behind the upright that the operator has both at the free lift position of the carriage and at the high lift maximum extension of the upright. When the carpet ram is elevated, it is necessary for the operator to view the tip through the top of the truck's overhead guard, as well as through the raised portions of the upright. The present invention takes into account that visibility is going to be reduced under such conditions, but the cylinders, lift chains and rails are spaced so that the operator has an optimum viewing angle through the top of the overhead guard without excessive head movement.

An upright for a different application, namely from marina operations where boats are lifted out of the water from below dock level and transported to a storage building and lifted to a high storage bay, is the subject of U. S. patent application entitled Lift Truck with Negative Drop Upright, filed Sep. 24, 1990, Ser. No. 07/586,042 and assigned to the present assignee. While this application has special purpose features making it highly suitable for marina applications, the competing objectives of high visibility uniform speed, load stability, load carriage free lift, and shorter load center to maximize load carrying capacity are all features and objectives resolved optimally with respect to the special requirements for carpet handling in the present invention, which objective features will be more apparent by reference to the following detailed description of the drawing.

DESCRIPTION OF THE PREFERRED EMBODIMENT

Figure 1:
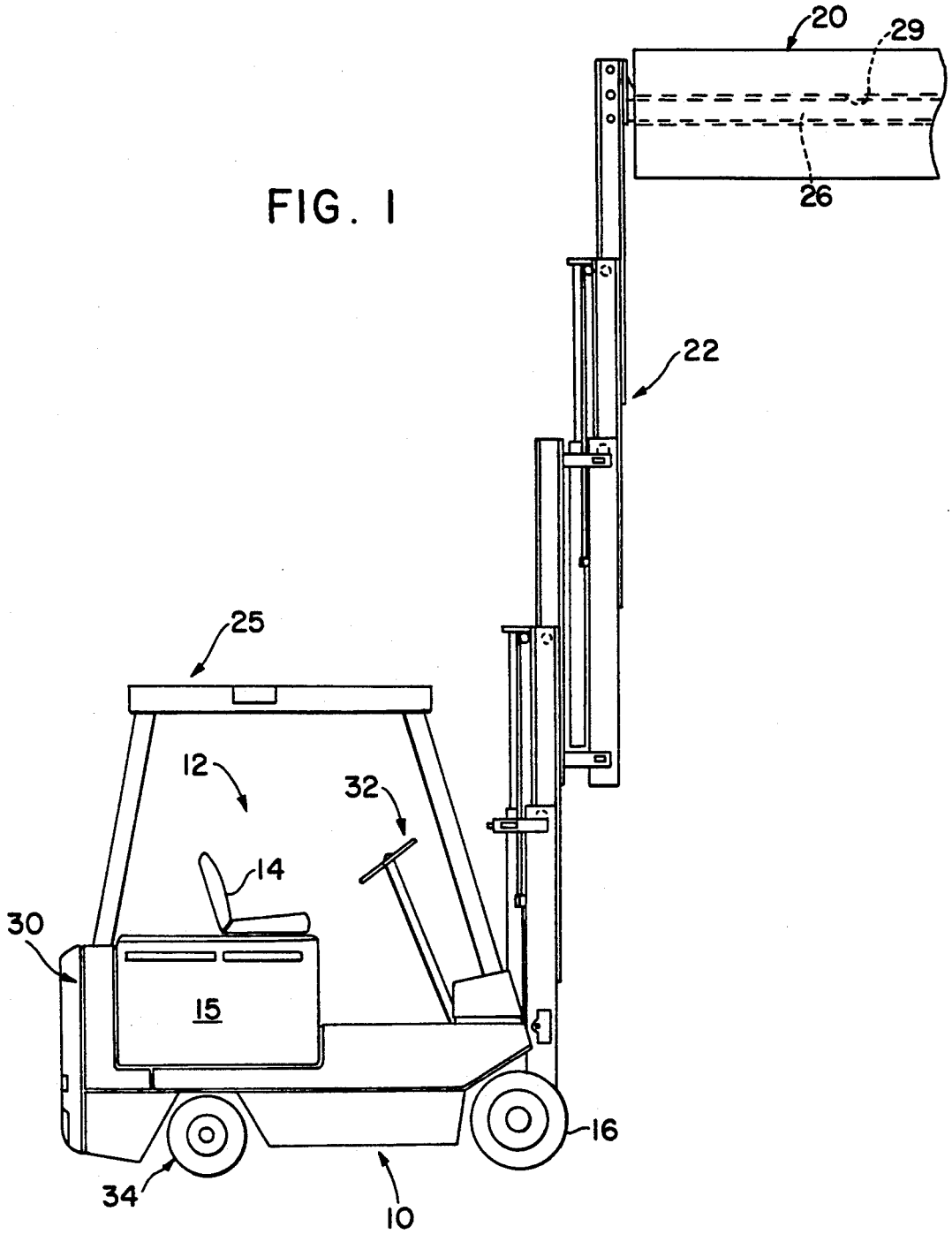
FIG. 1 is a side elevational view of a counterbalanced rider industrial truck having a five stage, sextuple upright and the load carriage having a carpet ram for lifting carpet rolls.
Figure 2A:
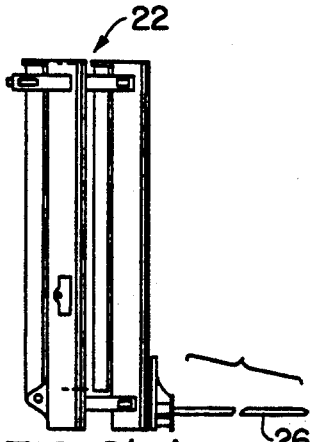
FIGS. 2(*a*) through 2(*d*) are sequential, partially exploded views showing different stages of elevation of the upright from fully collapsed and nested in FIG. 2(*a*) to fully extended and exploded in FIG. 2(*d*)
Figure 2B:
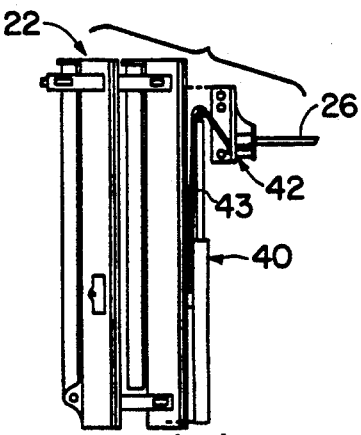
Figure 2C:
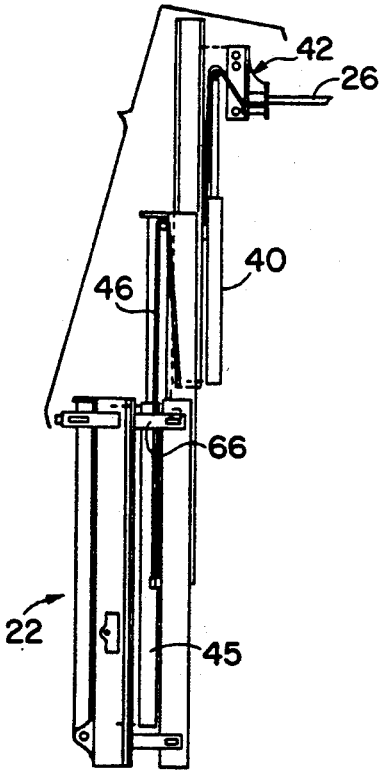
Figure 2D:
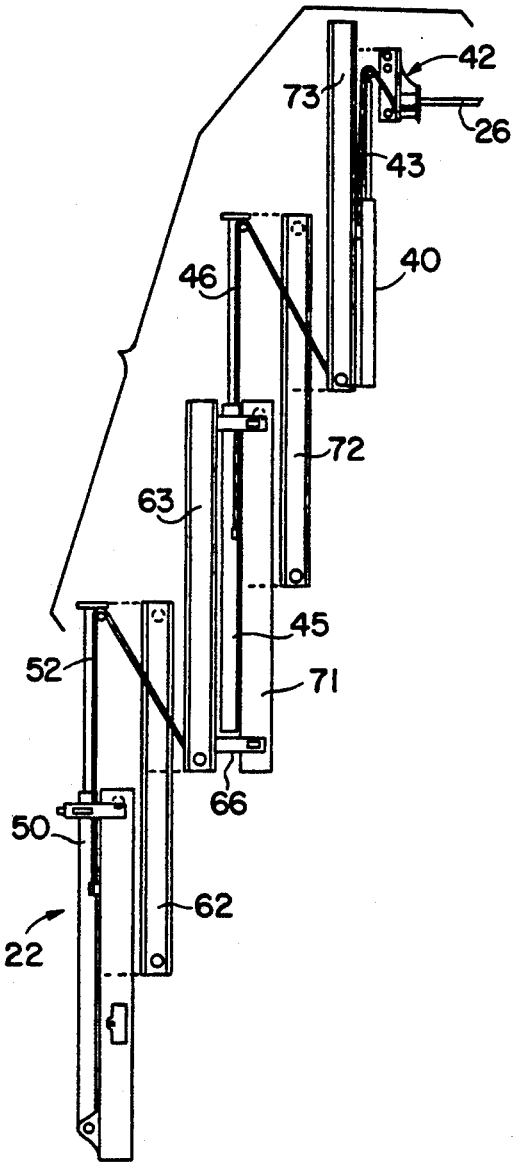
Figure 6:
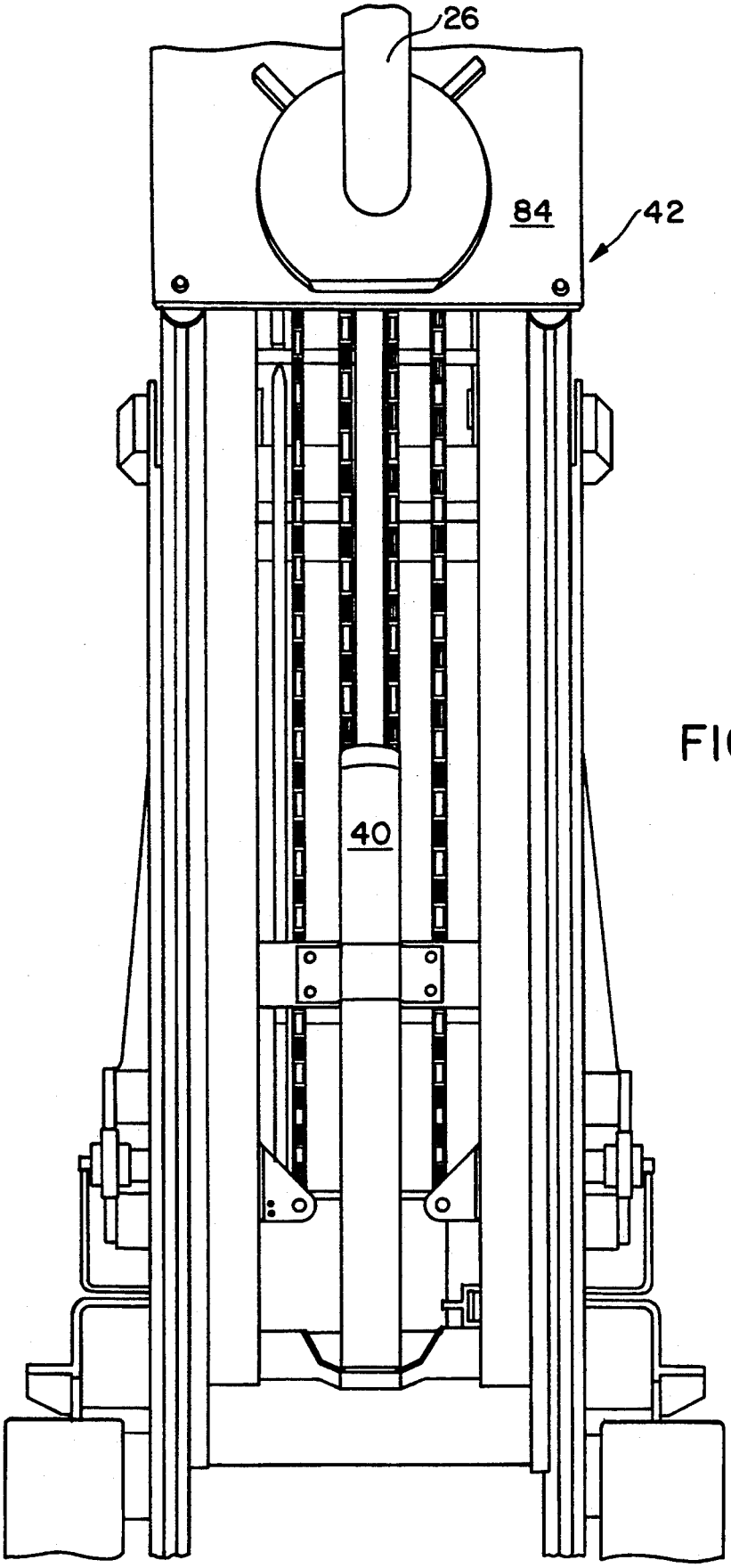
FIG. 6 is a view similar to FIG. 5 showing the load carriage lifted to its free lift height showing the visibility through the upright in the load carrying position.
Figure 7:
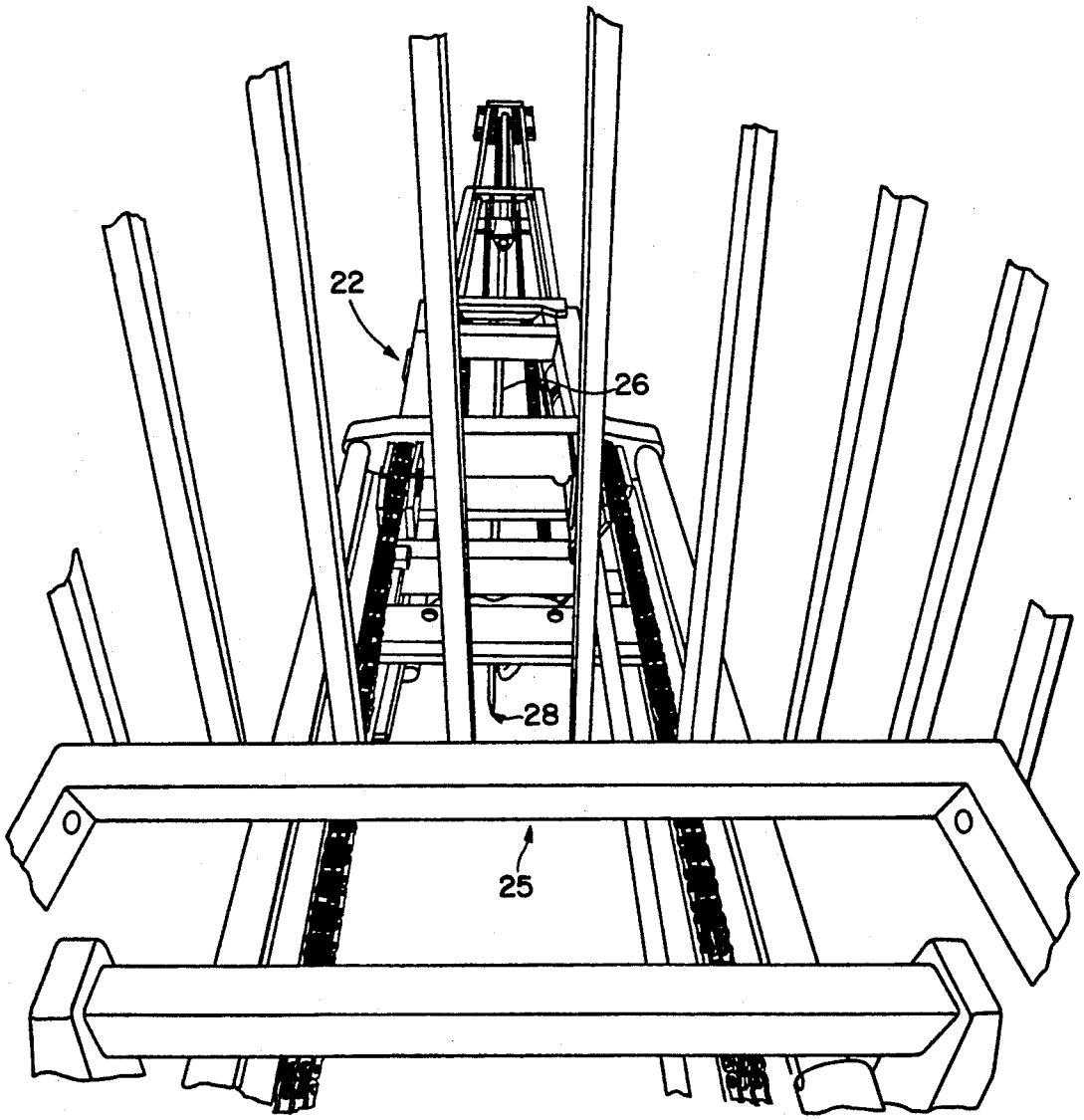
FIG. 7 is a view depicting the visibility through the upright at high lift from the operator's station looking up through the top bars of the overhead guard and the extended mast structure.

As shown generally in FIG. 1, a counter-balanced rider high lift truck, includes an operator's compartment, 12, having a seat, 14, facing forwardly positioned on a sheet metal battery cover, 15, for the electrical powered lift truck shown. Although it will be appreciated that the truck may be propelled by a gasoline, diesel, liquid propane or methane powered engine, the electrically powered truck powers front wheels, 16, in either a forward or reverse manner, by traction motors, not shown, coupled to the front wheels through gearing, or in the case of an engine driven truck, through a torque converter and transaxle driving an axle. In a warehouse where carpets are typically stored on twelve foot long rolls in high racks, one such roll, 20, is shown being lowered on the upright, 22. In the process of lowering the carpet roll, 20, after having lifted it from a rack perhaps thirty feet above the floor level in the warehouse, the truck is backed away to clear the carpet roll from racks, and commences to lower it to a transport position (FIG. 6). The upright retracts sequentially in a cascading fashion under the force of gravity as will be described in more detail hereinafter. An operator is seated on the operator's seat, 14, and has an optimum view, looking upwardly, through the top of the overhead guard, 25, and the extended masts (FIG. 7) of a carpet ram, 26. In picking up a carpet roll, the tip of the ram must be aligned with a carpet spool, 29, on which the carpet roll, 20, is wrapped creating unique visibility problems at these very high elevations. A counterweight, 30, counter-balances the load carried by the ram, 26, which acts through a load center about the front axle of the truck. As it is generally known in the lift truck industry, the capacity of the lift truck, 10, is varied by changing the counterweight, 30. By decreasing the distance between the front axle and the load center acting about the front wheel, larger loads may be lifted with smaller capacity trucks. It is important to recognize that the visibility of the operator through the top of the overhead guard, 25, takes into account the spacing of the bars in the overhead guard and the perspective relationship with the structure of the upright to give the operator relatively unobstructed vision of the tip of the carpet ram, 28, without excessive head movement seated in the operator's seat, 14. The carpet ram, 28, is visible (FIG. 7) at maximum lift height to facilitate inserting the carpet ram, 26, in the carpet spool, 29, without a lot of repositioning or maneuvering of the lift truck, 10, or operator head movement, thereby increasing productivity. The operator steers the lift truck, 10, from a steering wheel, 32, in a conventional manner through steering linkages connected to the rear steerable wheels, 34, which are capable of almost 90 degree angular turning for maximum maneuverability of the truck, 10, enabling it to almost turn within the length of the chassis of the truck, 10.

Referring to FIGS. 2(*a*) - 2(*d*), the upright, 22, is depicted at various stages of extension. FIG. 2(*a*) shows the upright, with the carpet ram, 26, partially broken away in the fully nested and collapsed or lower condition. FIG. 2(*b*) is similar to FIG. 2(*a*) except the lift cylinder and lift chain system, 40, for raising and lowering the load carriage, 42, and the carpet ram, 26, are shown in exploded relationship to the rest of the upright, 22. The load carriage, 42, is shown in FIG. 2(*b*) raised to approximately its full free lift height, before any extension has occurred of the upright, 22. FIG. 2(*c*) shows a first stage lift cylinder, 45, and lift chains, 46, elevated and partially exploded and FIG. 2(*d*), shows the second stage cylinder, 50, and lift chains, 52, added in exploded view. All lift cylinders and lift chains in FIG. 2(*d*) are in sequential extension with the upright rail sections cascading forwardly and upwardly. In operation, the upright is fully nested as depicted in FIG. 2(*a*), which compares with the exploded view in FIG. 2(*d*).

Figure 3:
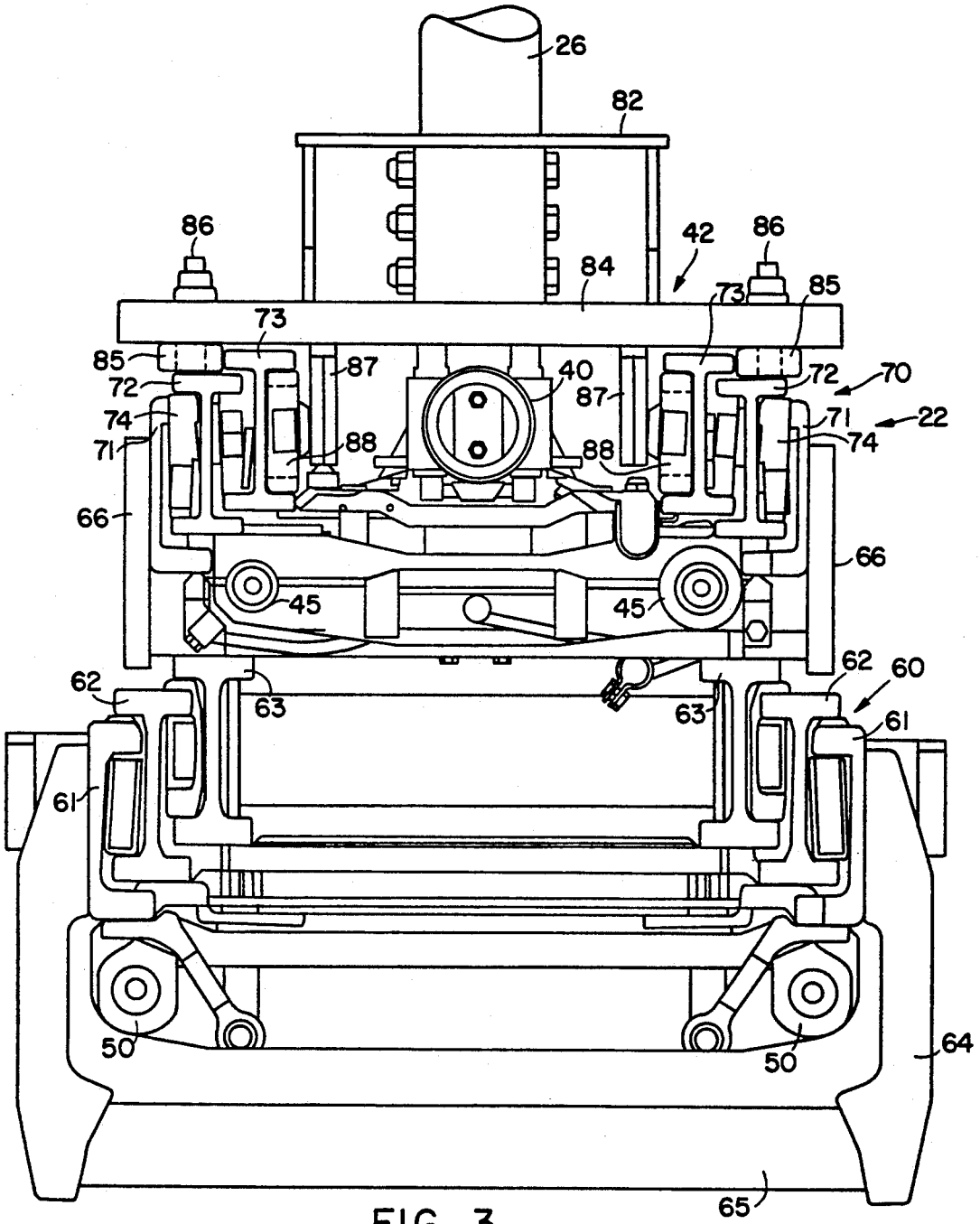
FIG. 3 is an overhead view of the upright showing the carpet ram at the front partially broken mounted on the load carriage.

Referring to FIG. 3, it will be appreciated that this is an overhead view of the upright, 22, facing forwardly in the direction of travel of the truck, 10, with the ram, 26, shown partially broken away mounted on the carriage, 42. The upright, 22, comprises a first or rear mast section, 60, and a second or front mast section, 70, each having outer, intermediate and inner rails, 61, 62, 63, and 71, 72, 73, respectively, traveling on roller pairs, 74, held in rigid laterally spaced relationship. Outer rails, 61, are held by tiebars, 64, connected at the rear by a crossmember, 65. The intermediate and inner rails are similarly held in rigid spaced relationship. The inner rails, 63, of the rear mast section, 60, have heavy structural side plates, 66, rigidly joined to the outer surfaces of the outer rails, 71, as by welding so that the front mast section, 70, is recessed toward the rear mast section. By extension of the rails 73, 72, cascading out of the front mast section, 70, reaching their full extension, rails, 63, 62, then commence to cascade out of the rear mast section, 60. However, before this mast sequencing occurs, the load carriage, 42, will be raised to its free lift height, the maximum height of the carriage on the upright prior to any extension having occurred of the rails (FIG. 6).

Figure 4:
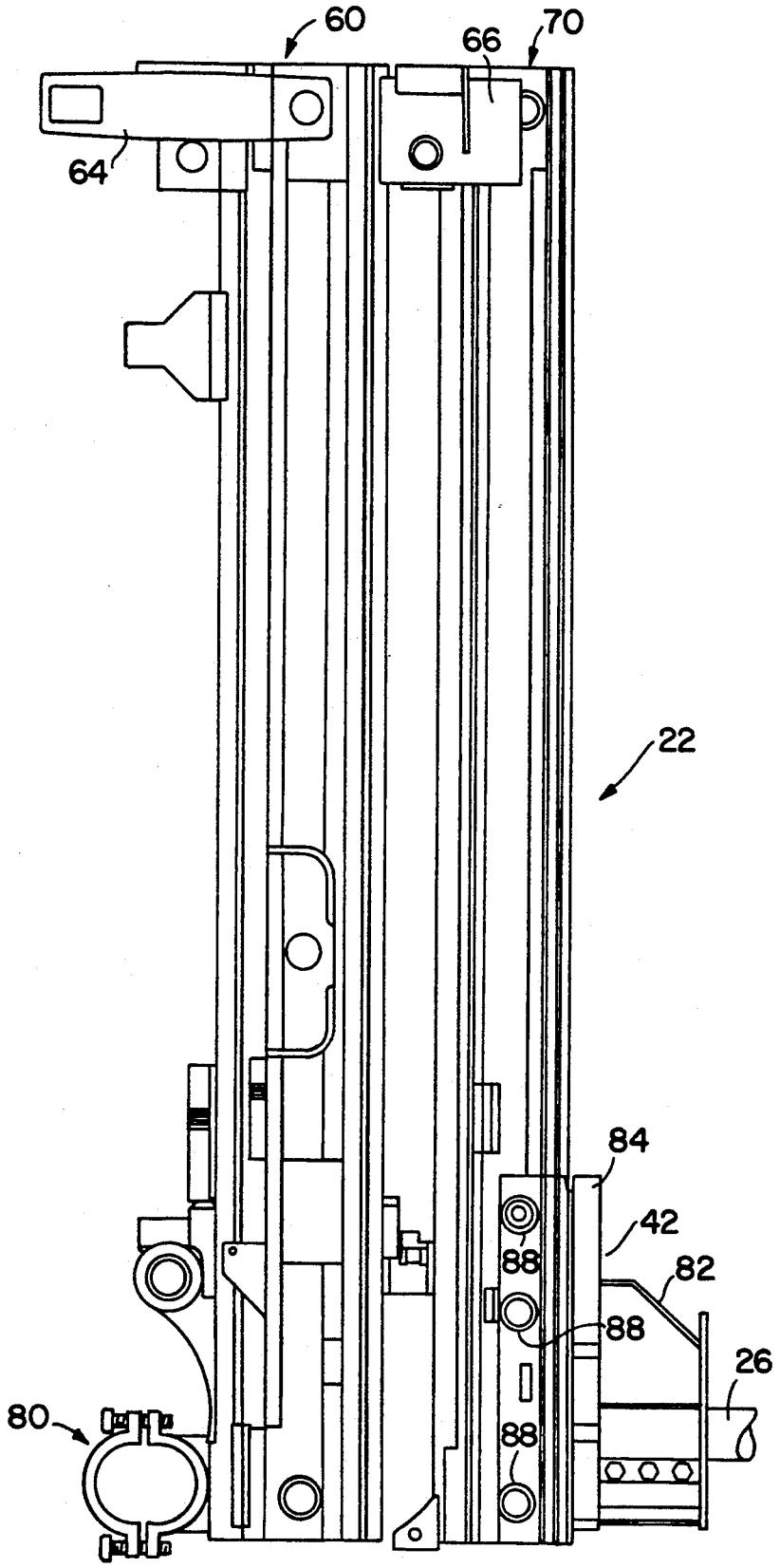
FIG. 4 is a side elevational view of the upright showing the longitudinally compact overlapped relationship of the dual mast sections; rails.
Figure 5:
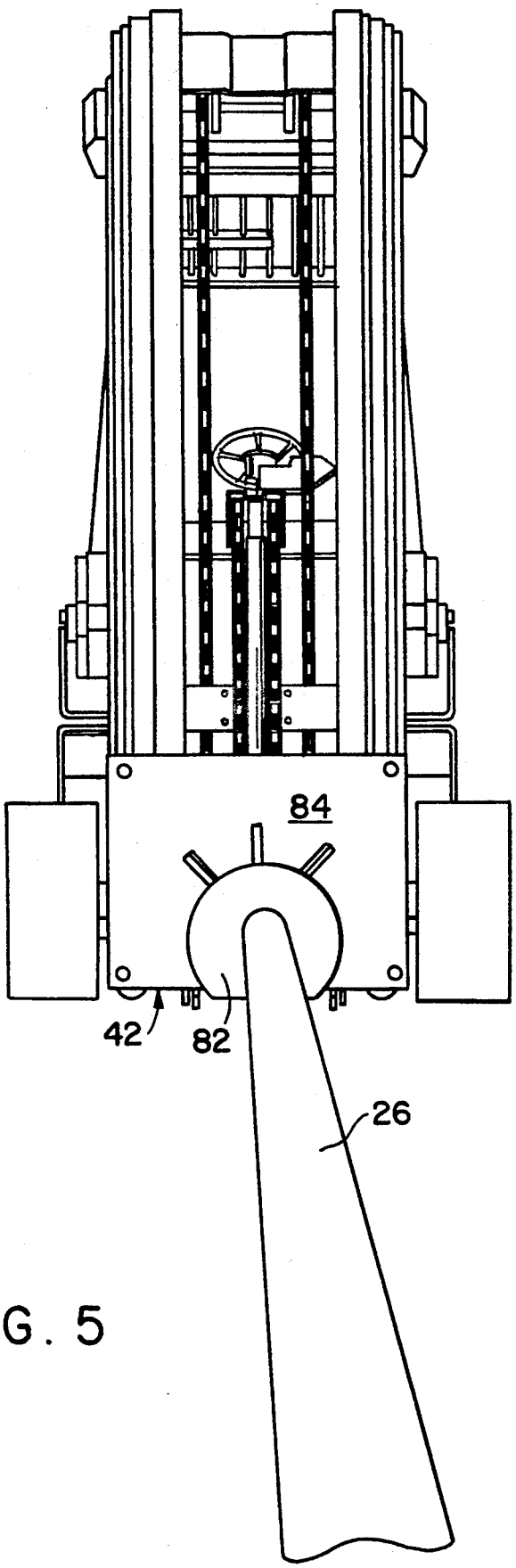
FIG. 5 is a front elevational view of the upright mounted on a lift truck showing the load carriage in the lowered position depicting the operator's visibility in the "window" above the carriage lift cylinder.

It will now be more apparent by reference to FIG. 2(*a*) - 2(*d*) and FIG. 3 that hydraulic cylinders, 40, 45 and 50 through the associated lift chains, 43, 46 and 52 are operated sequentially by the lift system of the truck, 10, which includes a hydraulic pump for supplying hydraulic pressure to the cylinders. A lift valve, not shown, allows the hydraulic fluid to return to a reservoir on the truck under the force of gravity sequentially exhausting fluid from each cylinder. Lift cylinder, 40, has a sheave at the end of the cylinder rod over which the lift chains, 43, travel. One end of the chains is attached to the load carriage, 42, and the other end to the inner rails of the front mast section such that only the load carriage, 42, is elevated as depicted in FIG. 2(*b*). Similarly, in sequencing the cylinders, 45, the intermediate rails, 72, are raised and the lift chains, 46, traveling over a sheave at the end of the cylinder rod, elevates the inner rails, 73 of the front mast section at a 2 to 1 ratio. When cylinders, 45, have been fully extended, cylinders, 50, commence to extend causing the intermediate rails, 63, to elevate out of the fixed rails, 61 of the rear mast section, 60. The lift chains, 52, traveling over sheaves at the top of the cylinder rods connected to the inner rails, 63, and cause them to elevate at a 2 to 1 ratio to the speed of rails, 62, which are directly connected to the cylinder rod of cylinder, 50. In lowering the upright, the cascading action is reversed with the cylinders collapsing in reverse order and the load carriage and mast sections returning to the fully lowered state as depicted in FIGS. 4 and 5. The upright, 22, is mounted on the front axles of the truck by bushings generally depicted at 80 in a known manner which allows it to be tilted by means of hydraulic cylinders, not shown, connected to the truck's hydraulic circuit such that the tilt cylinders, not shown, extend or retract in pivoting the entire upright about the front axles through several degrees of movement for obtaining the required positioning of the load.

FIG. 5 is a front view of the upright shown mounted on the lift truck with the load carriage, 42, lowered. The carpet ram, 26, is supported rigidly on a bracket structure, 82. The load carriage, 42, has a back plate, 84, at the corners of which are side thrust rollers, 85, mounted on stub shafts, 86, adjustable in a known manner for centering and guiding the load carriage along the edges of rail, 73, (FIG. 3). Plate 84 has rearward extensions, 87, which carry a plurality of roller pairs, 88, traveling longitudinally within the inner rails, 73, and spaced vertically so as to uniformly distribute the load on the rails, 73, and minimize rail distortion. It will be appreciated that one of the features of the invention is that the load carriage rollers, in cooperation with the side thrust rollers, 85, firmly guide the carriage vertically relative to the center line of the upright so that the carpet ram, 26, is always positioned on such line for maximum stability and productivity due to the need for alignment with high stack conditions. In addition, the load carriage, 42, has a compact offset, recessed relationship with the mast section 70. The setback is such that carriage is flush with the front of the upright, reducing by several inches the load center from what would otherwise be expected with a standard carriage. Hence, due to the highly compact arrangement of the first and second mast sections, 60, 70, together with the load carriage, 42, the load center is several inches, at least 5 to 6 inches, closer to the front axles of the lift truck thereby enabling a lift truck with a lower capacity, or smaller counterweight, to be used in lifting loads that would otherwise require a larger lift truck.

In addition, the load carriage does not extend laterally beyond the sides of the outer rail of the front mast reducing the chance of damage to racks. Also, it will be appreciated that in the full free lift condition (FIG. 6) the back plate, 84, remains below the top of the inner rails, 73. This minimizes the possibility of damage to trailers.

In the load carry position (FIG. 6) due to the offset and overlapping relationship of the masts, the operator has relative unobstructed vision through the upright below the load carriage, 42. In the lowered position (FIG. 5) the "window" of vision over the cylinder, 40, is greater improving productivity since the operator can drive forwardly, rather than in reverse, without a load.

It will be appreciated that while a special purpose upright has been described as the preferred embodiment of the invention with reference to material handling applications in a carpet warehouse, the upright has wider uses and applications which are not intended to be restricted or limited by the description of the preferred embodiment, nor is there any intention in the use of terms or expressions to exclude equivalence of the features shown and described accomplishing substantially the same function in substantially the same way, it being recognized that the scope of the invention is defined and limited by only the claims which follow:

What is claimed is:

1. A load lifting apparatus comprising front and rear, first and second, fore and aft mast sections;

each mast section comprising outer, intermediate and inner rails, laterally offset and partially overlapped, said outer rails of the front mast section being joined to the inner rails of the rear mast section in structurally close coupled, front to back relationship;

anti-friction means supporting the intermediate and inner rails for telescopic extension relative to each other and the outer rails of the front mast section traveling in unison with the inner rails of the rear mast section;

powered lift means connected to the rails so as to elevate the intermediate and inner rails in cascading fashion and a load carriage traveling on the inner rails of the front mast section such that a high lift is obtained with maximum lift capacity owing to the compact fore and aft relationship of the mast sections.

2. The load lifting apparatus of claim 1 wherein the load carriage is first sequenced to elevate prior to sequencing of the rails, said carriage traveling to its full height below the top of the rails in its free lift position prior to any extension occurring of the rails thereby minimizing the chance of hitting overhead obstructions.

3. The load lifting apparatus of claim 1 wherein the carriage comprises a back plate, antifriction means traveling in the rails mounting the back plate; other anti-friction means traveling on the longitudinal edges of the rails for stabilizing the carriage to uniformly distribute the load being lifted and minimize rail distortion.

4. The load lifting apparatus of claim 3 wherein the load carriage supports a carpet ram;

said carpet ram being rigidly secured to the back plate of the load carriage centered relative to the rails, and said other anti-friction means being adjustable so the carpet ram can be re-centered when laterally misaligned relative to the center line between the rails.

5. The load lifting apparatus of claim 4 wherein the carpet ram is the length of a carpet spool and;

the distal end of the carpet ram is visible from the operator's position in the raised position of the mast sections enabling it to be aligned more readily with the carpet spool.

6. In a counter balanced high lift truck having an operator's seat facing forwardly, a counterweight at the rear of the truck, a power source for propelling and maneuvering the truck and for providing hydraulic power for operating the systems of the truck, drive wheels at the front of the truck connected to the power source for propelling the truck in a forward or reverse manner, a steering wheel, steer wheels at the rear of the truck, a steering linkage connecting the steering wheel to the steer wheels for turning them in maneuvering the truck, the improvement comprising:

an upright pivotally supported on the drive wheels which can be tilted forwardly or rearwardly from a vertical position when engaging loads to be picked up, transported and elevated;

said upright comprising first and second, front and rear, dual mast sections, disposed in fore and aft stacked relationship with each other, each having laterally spaced outer, intermediate and inner rails, offset outwardly from the centerline of the upright and partially overlapped fore and aft in nested relationship to provide a wide "window" for viewing forward of the upright, said outer rails of the front mast section fixed to the inner rials of the rear mast section, a load carriage elevatable on the inner rails of the front mast section, and lift means for extending the load carriage, and then sequentially the mast sections with the inner and intermediate rails of the front mast section extending, then those of the rear mast section relative to each other, to a maximum lift height whereby the operator has optimum visibility of the load at all levels of work.

7. The improvement according to claim 6 wherein the rear mast section is joined to the front mast section by structural plates laterally spaced by and projecting forwardly from the inner rails of the rear mast section receiving the outer rails of the front mast section in close-coupled relation to the rear mast section to provide a compact structure reducing the load center of the upright.

8. The improvement according to the preceding claim 7 wherein the load carriage comprises;

a back plate, side thrust rollers on the back plate traveling on the edges of the inner rails of the front mast section, vertically spaced carriage rollers traveling in the inner rails of the front mast section for raising and lowering the carriage and supporting the load, a carpet ram rigidly secured to the back plate and extending longitudinally approximately the length of a standard carpet roll, said back plate being positioned relative to the rails to center the carpet ram between the rails.

9. The improvement according to claim 8 wherein the carriage is raised to a free lift position when carrying a carpet roll in a transport position at which the top of the carriage is below the top of the inner rails of the front mast section and the carriage rollers remain inside the rails for uniform distribution of the forces.

10. The improvement according to claim 9 wherein the side thrust rollers are adjustable to position the carriage on the vertical centerline of the upright.

11. The improvement according to claim 10 wherein the lateral carriage dimensions are within the width of the upright and the vertical height of the back plate is such as to provide a relatively unobstructed wide and vertically up and down view of the work through the "window" of the upright when traveling with a load.

12. The improvement according to claim 11 wherein the top of the carriage does not extend beyond the top of the inner rails of the front mast section at full extension of both mast sections.

* * * * *